US007695094B2

(12) United States Patent
Sloan, Jr. et al.

(10) Patent No.: US 7,695,094 B2
(45) Date of Patent: Apr. 13, 2010

(54) SHIELD ASSEMBLY FOR INK JET PRINTING

(75) Inventors: Richard A. Sloan, Jr., Southbury, CT (US); Christopher Mallick, Wallingford, CT (US)

(73) Assignee: Pitney Bowes Inc., Stamford, CT (US)

( * ) Notice: Subject to any disclaimer, the term of this patent is extended or adjusted under 35 U.S.C. 154(b) by 727 days.

(21) Appl. No.: 11/541,259

(22) Filed: Sep. 29, 2006

(65) Prior Publication Data

US 2008/0079770 A1 Apr. 3, 2008

(51) Int. Cl.
*B41J 2/165* (2006.01)

(52) U.S. Cl. ..... 347/22

(58) Field of Classification Search ..... 347/37, 347/104

See application file for complete search history.

(56) References Cited

U.S. PATENT DOCUMENTS 2,166,131 A * 7/1939 Duncan ..... 281/11
4,859,099 A * 8/1989 Kanemoto et al. ..... 400/636.1
4,872,026 A * 10/1989 Rasmussen et al. ..... 347/56

* cited by examiner

*Primary Examiner*—Julian D Huffman
*Assistant Examiner*—Alexander C Witkowski
(74) *Attorney, Agent, or Firm*—Brian A. Collins; Angelo N. Chaclas

(57) ABSTRACT

A shield assembly is provided for use in combination an ink jet printer and is operative to provide a smooth planar surface for printing on a print media. The described embodiment includes a shield having first and second contact surfaces to define an opening therebetween. The opening of the shield assembly is aligned with the print head of the ink jet printer for permitting the deposition of ink through the opening. The assembly further includes a pivot mount operative to pivot the shield about a rotational axis which is substantially parallel to the feed path of the print media and orthogonal to the motion of the print head. Moreover, the assembly includes a means for pivoting the shield about the rotational axis in a first and second direction thereby causing one of the contact surfaces to engage the print media upstream of the print head when depositing ink on the print media.

18 Claims, 4 Drawing Sheets

SHIELD ASSEMBLY FOR INK JET PRINTING

TECHNICAL FIELD

This invention relates to ink jet printers and, more particularly, to a new and useful shield assembly for optimally preparing the print surface or surface contour of the print media during print operations.

BACKGROUND ART

Conventional inkjet printers employ a print head assembly having an array of individual nozzles for deposition of ink onto a substrate media or material e.g., plain white paper or a mailpiece envelope. The print head assembly is adapted to accommodate one of two types of print/feed mechanisms, namely, shuttle and in-line printing. Shuttle motion printers employ a moveable print head assembly capable of shuttling back and forth in a direction orthogonal to the direction of paper feed. Consequently, shuttle print head assemblies are capable of fully covering the printable area of a page in bands of coverage. In-line printing, in contrast, employs a stationary print head assembly having a fixed width. Generally, in-line print head assemblies comprise a plurality of adjacent print heads to cover a predetermined print area or region as paper is fed beneath the print heads.

In FIGS. 1*a* and 1*b* a conventional prior art shuttle print head assembly 100 comprises a carriage assembly 110 for containing one or more individual print heads 112. The carriage assembly 110 is typically connected to a guide rail 114 to fix the print head 112 in two axes and a positioning mechanism (not shown) to control movement in an axis perpendicular to the feed path (in the direction of arrow FP) of the media 116. As mentioned in a preceding paragraph, the shuttle print head assembly 100 is capable of covering the entire face surface of the media 116, i.e., bi-directionally along arrow SP (see FIG. 1*a*), by incrementally moving media 116 through the print station as the print head 112 passes back and forth in bands of coverage.

To ensure that the print head 112 prints on a substantially planar surface, it is common to employ a movable shield 120 proximal to the print head 112 to press the media 116 against an underlying support structure 122, i.e., typically a resilient elastomer roller or feed cylinder. Furthermore, the shield 120 may be adjusted vertically along bi-directional arrows AV to accommodate thickness variations in print media 116 such as mailpiece envelopes. Due to the bi-directional motion SP of the print head assembly 100 and the direction FP of the feed path, the shield 120 must necessarily be disposed behind the print head 112 and parallel its shuttle motion SP. While the shield 120 is as close as practicable to the print head 112, it will be appreciated that the ability to control the surface contour of the print media diminishes as the distance from the shield increases. Consequently, as best seen in FIG. 1*b*, the shield 120 exerts less influence over a region D which distally located as compared to region A which is proximal to the shield 120.

In FIG. 1*c*, an in-line print head assembly 200 is depicted wherein the carriage assembly 210, including the print head 212, is essentially fixed relative to a supporting rail 214. The underlying print media 216 is conveyed along feed path a FP by linear belts 218 which pass beneath the print head 212. Such in-line print heads 212 typically employ a fixed shield 220 disposed along the leading edge LE of the print head 212, i.e., laterally of the print head 212, and in-advance of the print media 216. Further, to minimize complexity, the fixed shield 220 is typically rigidly mounted to the carriage assembly 210, near the print head 212, and spring biased against the print media 216.

The shield 220 may be configured and mounted in the manner described above principally due to the unidirectional motion of the underlying print media 216. That is, inasmuch as the ink requires a fixed amount of time, albeit small, to dry, the shield 220 may be located along the leading edge LE or upstream of the print head 212, to avoid contact with the drying ink. Additionally, the shield 220 may optimally positioned along side the print head 212 to further improve the efficacy of printing, i.e., controlling the surface contour in region A with greater precision.

While the mounting arrangement of the shield 220 is optimally suited for in-line printing assemblies 200, i.e., wherein the print media 216 moves in a single direction relative to the print head 212, it will be appreciated that a similar mounting arrangement is not possible for shuttle motion printers. That is, should a pair of shields be disposed on each side of a shuttling print head, one of the shields, i.e., the shield disposed downstream of ink deposition will interfere with the drying ink.

A need, therefore, exists for a shield assembly which optimally controls the surface contour of underlying print media while enabling both in-line and shuttle ink-jet printing.

BRIEF DESCRIPTION OF THE DRAWINGS

The accompanying drawings illustrate presently preferred embodiments of the invention and, together with the general description given above and the detailed description given below serve to explain the principles of the invention. As shown throughout the drawings, like reference numerals designate like or corresponding parts.

SUMMARY OF THE INVENTION

Figure 1A:
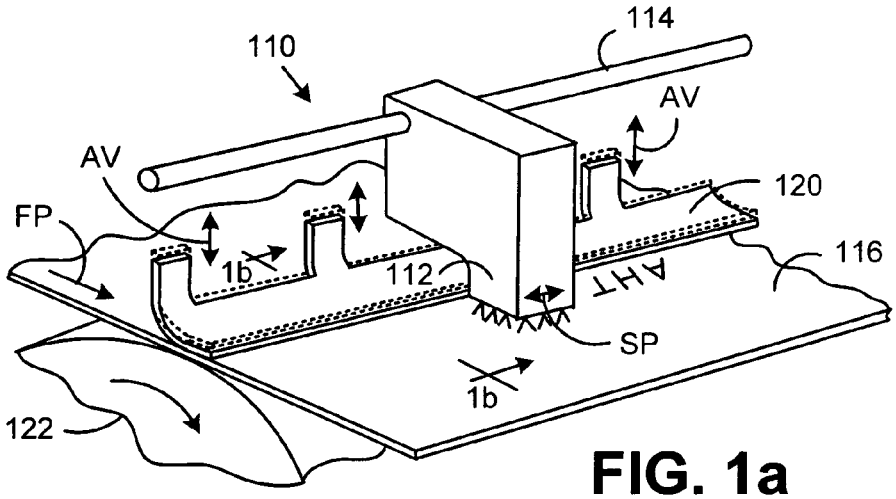
FIG. 1a ( PRIOR ART )
FIG. 1*a* is a perspective view of a prior art shuttle ink jet printing assembly including a moveable shield disposed behind and parallel to the side-to-side or shuttle motion of the print head SP.
Figure 1B:
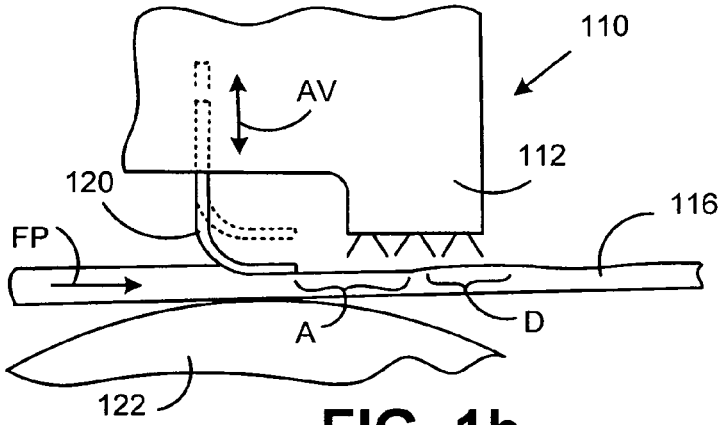
FIG. 1b ( PRIOR ART )
FIG. 1*b* is a sectional view taken substantially along line 1*b*-1*b* of FIG. 1*a* depicting the spatial position of the shield relative to the print head.
Figure 1C:
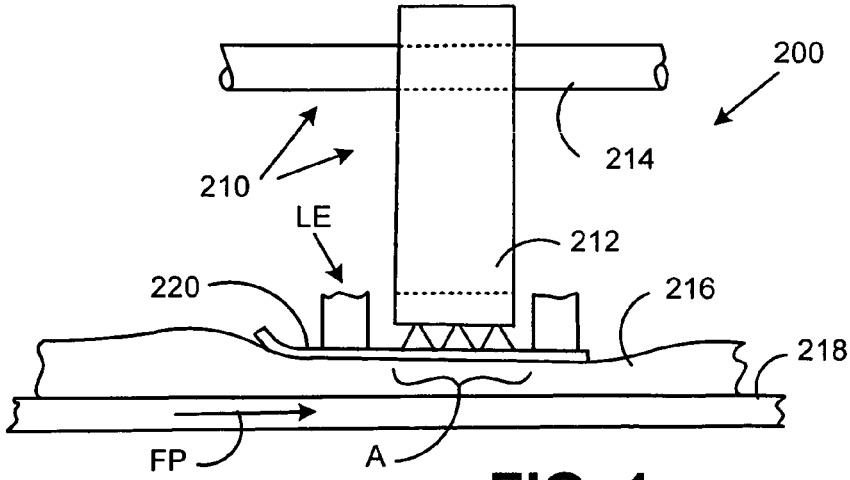
FIG. 1c ( PRIOR ART )
FIG. 1*c* is a front view of a prior art in-line ink jet printing assembly including a fixed shield disposed laterally along the leading edge and up stream of the print head to avoid the drying ink.
Figure 2:
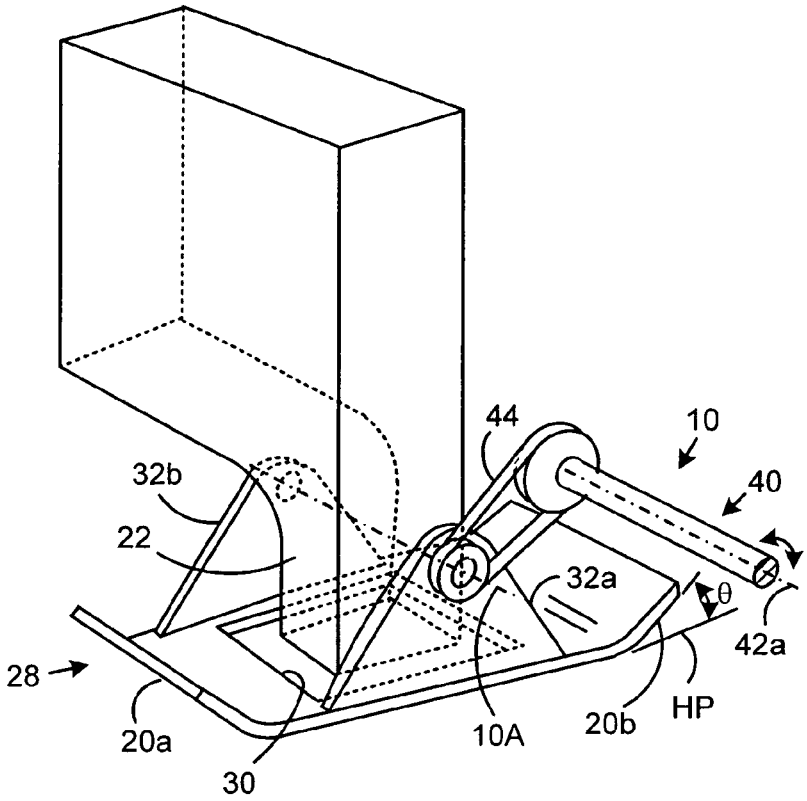
FIG. 2 is a schematic perspective view of the inventive shield assembly, a print head and a means for effecting pivot motion of a shield about a rotational axis.

A shield assembly is provided for use in combination an ink jet printer and is operative to provide a smooth planar surface for printing on a print media. The assembly includes a shield having first and second contact surfaces which define an opening therebetween. The opening of the shield assembly is aligned with the print head of the ink jet printer for permitting the deposition of ink through the opening. The assembly further includes a pivot mount operative to pivot the shield about a rotational axis which is substantially parallel to the feed path of the print media and orthogonal to the motion of the print head. Moreover, the assembly includes a means for pivoting the shield about the rotational axis in a first and second direction thereby causing one of the contact surfaces to engage the print media upstream of the print head when depositing ink on the print media.

DETAILED DESCRIPTION

The present invention is described in the context of a conventional ink-jet printer having a carriage assembly for bi-directionally shuttling a print head during print operations. While the configuration described includes a conventional carriage assembly guided and displaced along a rail, it should be appreciated that the printing method and shield assembly employed can be adapted for use with any print head assembly which is bi-directionally guided or controlled to print on a print media. Further, while the shield assembly is described in the context of printing on a mailpiece envelope, the invention is applicable to printing on any sheet material, particularly those which may be subject to thickness variations or fluctuations of its surface contour.

In the broadest sense of the invention, and referring to FIGS. 2 through 5, a method for ink-jet printing is provided for printing on a print media such as a mailpiece envelope. The method includes the steps of (i) affixing or attaching a shield assembly 10 to a print carriage 12 of the ink-jet printer and (ii) displacing the shield assembly 10 to engage print media 14 upstream of the print carriage 12 as the carriage 12 bi-directionally shuttles in one of two directions (shown by arrow BD) relative to the print media 14. In the described embodiment, the shield assembly 10 includes contact surfaces 20*a*, 20*b* disposed on each side of a print head nozzle 22 which is housed in and supported by the print head carriage 12. Functionally, the contact surfaces 20*a*, 20*b* are adapted to engage the print media 14 so as to provide a smooth planar surface 26 (see FIG. 3) as the nozzle 22 deposits ink on the print media 14. The planar surface 26 prepared by the shield assembly 10 alleviates surface irregularities which may lead to poor print quality/readability.

In the described embodiment, the shield assembly 10 includes a shield 28 forming a unitary structural plate which is pivot mounted to the print carriage 12 about a rotational axis 10A. The structural shield plate 28 may be stamped from sheets of stainless steel and include an opening or aperture 30 disposed between the contact surfaces 20*a*, 20*b*. Furthermore, mounting lugs 32*a*, 32*b* may be formed during plate manufacture so that pins 34 pivotally mount the plate 28 to the print head carriage 12. In the described embodiment, pins 34 mount the shield 28 to cross members 36 (best seen in FIG. 4) of the print head carriage 12, though the shield 28 may be pivot mounted to any structure which permits rotation of the shield assembly 10 about an axis 10A orthogonal to the direction of print head motion BD.

Figure 4:
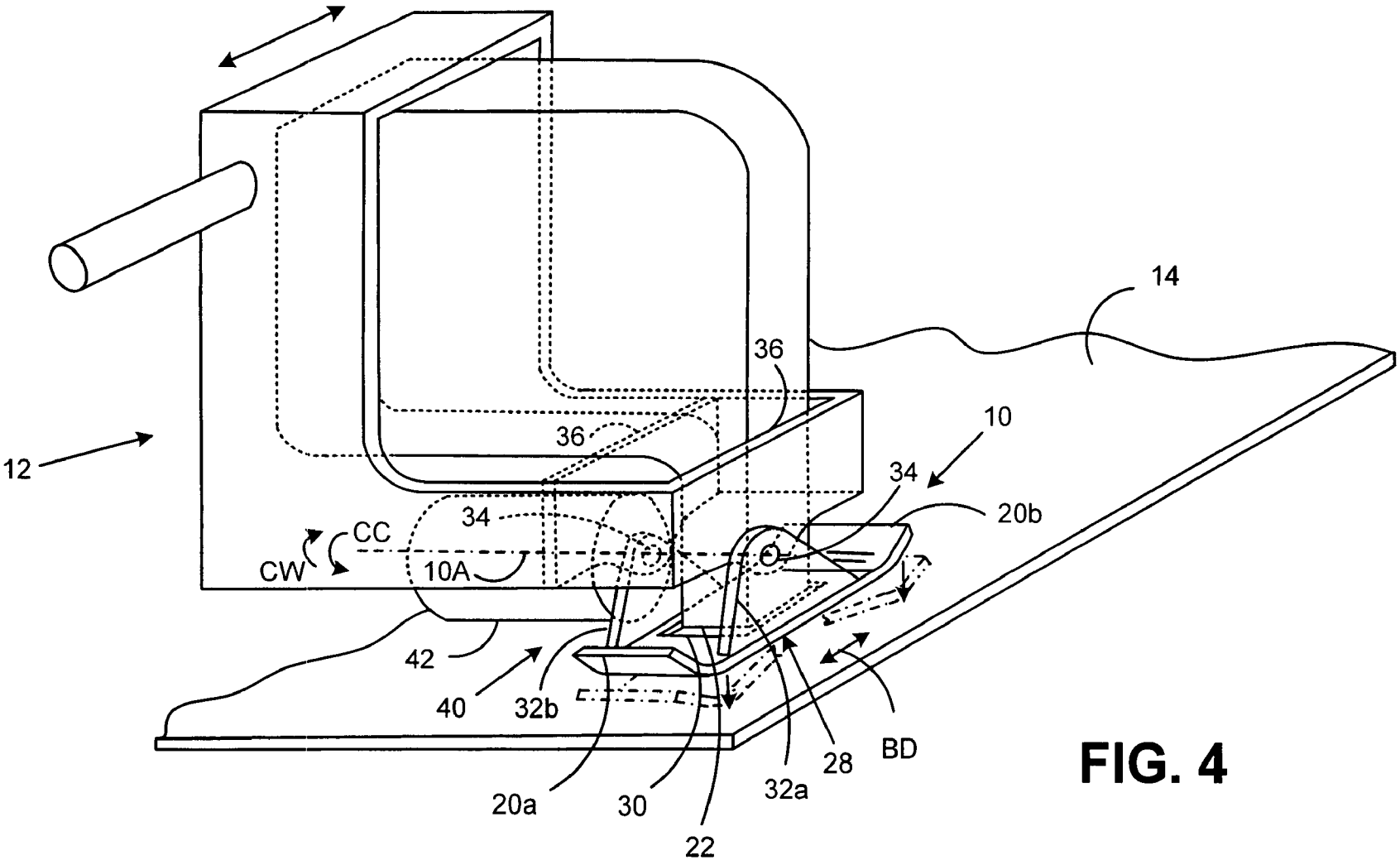
FIG. 4 is a schematic perspective view of a shield assembly disposed in combination with the printer carriage and a bi-directional actuator for positioning the assembly about an axis which is co-axially aligned with a drive shaft of the actuator.
Figure 5:
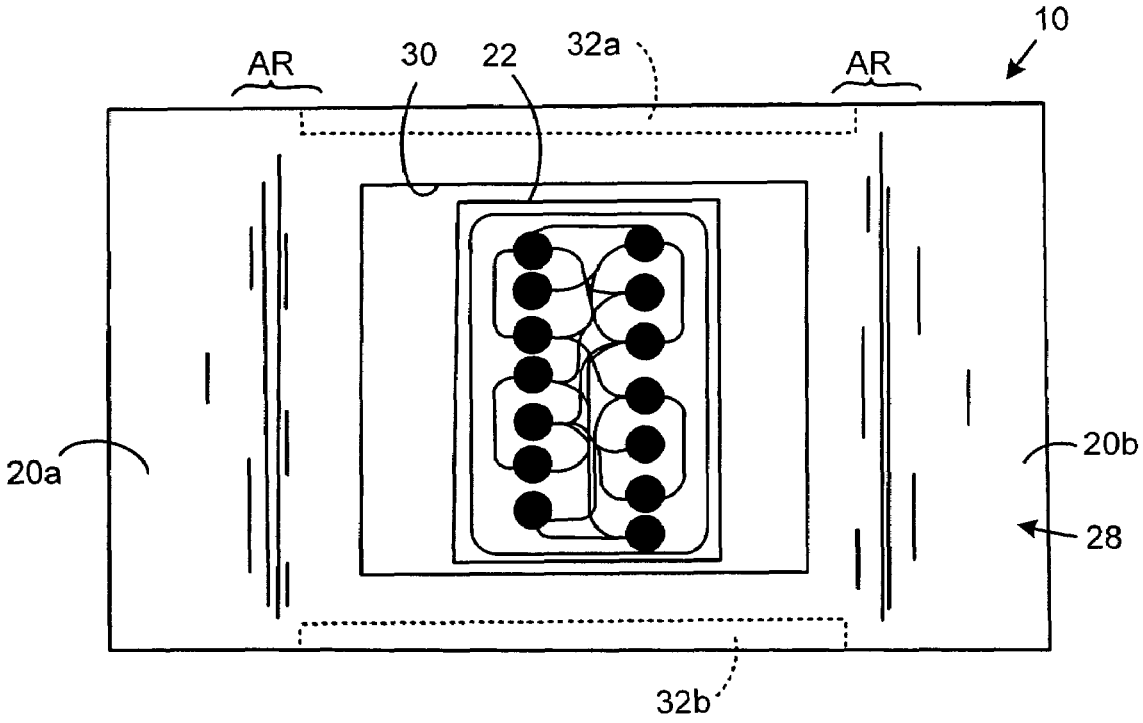
FIG. 5 is a sectional view taken substantially along line 5-5 of FIG. 4 depicting the underside of the shield assembly.

In FIGS. 4 and 5, the opening 30 of the shield 28 is oversized relative to the print head nozzle 22 and generally compliments its face geometry. In addition to permitting ink to pass through the shield plate 28, the oversized dimensions of the opening 30 enable to the shield assembly 10 to pivot unencumbered relative to the print head nozzle 22, i.e., which may project through the opening 30. While the described embodiment depicts the nozzle 22 and opening 30 as having a substantially rectangular geometry, it should be appreciated that the nozzle 22 and opening 30 need not be rectangular nor have a geometry which is complimentary. In fact, the shield assembly 10 need not define an aperture 30, but simply access between contact surfaces 20*a*, 20*b*, to permit the deposition of ink onto the print media 14.

Figure 3:
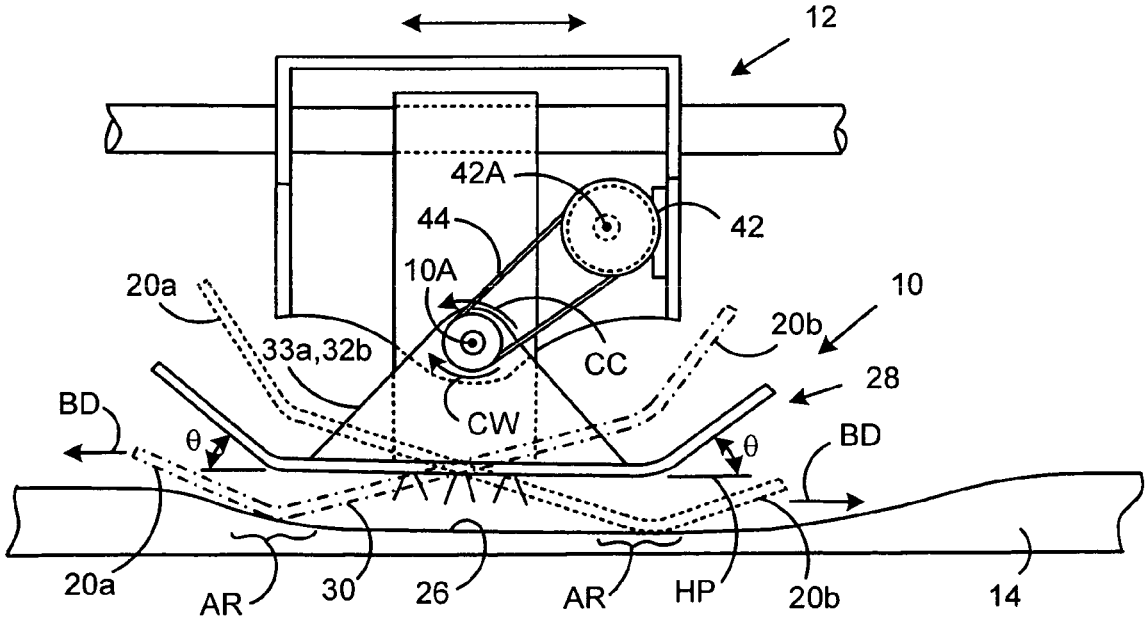
FIG. 3 is a front view of the shield mounted to a print head assembly carriage illustrating the rotational positions of the shield as the carriage assembly shuttles the print head from side to side during print operations.

In FIGS. 3 and 4, the shield assembly 10 also includes a means 40 for pivoting the contact surfaces 20*a*, 20*b* of the shield 28 into engagement with the underlying print media 14. In the described embodiment a drive motor 42 is rotationally coupled to the plate 28 and may be driven in one of two directions, i.e., clockwise or counterclockwise in the direction of arrows CW and CC, respectively, about the rotational axis 10A. For example, in FIG. 3, the motor 42 drives a belt 44 which, in turn, rotates one of the contact surfaces 20*a*, 20*b*, i.e., the ramped surface leading the print head nozzle 22, into contiguous engagement with the print media 14. Consequently, the shaft axis 42A of the motor 42 is displaced relative to the rotational axis 10A of the shield assembly 10. In FIG. 4, a motor 46 is co-axially aligned with the rotational axis 10A such that the motor may directly drive the clockwise and counterclockwise rotation of the shield 28.

In the described embodiment, the contact surfaces 20*a*, 20*b* are configured to facilitate sliding contact with the print media 14. Consequently, the contact surfaces may define an arcuate region or bend which causes the surfaces 20*a*, 20*b* to define a shallow or acute angle E (see FIG. 3) relative to a horizontal plane or to the print media 14. In the described embodiment, the contact surfaces produce ramps defining an angle ranging from about ten degrees (10°) to about thirty-five (35°) degrees relative to a horizontal plane.

In summary, the shield assembly provides a reliable, low cost method for optimally preparing the surface contour of underlying print media for in-line and bi-directional inkjet printing. Furthermore, the shield assembly may be incorporated with minimal structural changes to existing ink-jet printer hardware and software. Moreover, the proximity of the shield relative to the print head nozzle provides optimum surface contour control, i.e., control of the print media surface.

Although the invention has been described with respect to a preferred embodiment thereof, it will be understood by those skilled in the art that the foregoing and various other changes, omissions and deviations in the form and detail thereof may be made without departing from the scope of this invention.

While the invention has been described in the context of a motor driven shield assembly, it will be appreciated that other means for actuating or positioning the shield assembly could be employed. For example, a simple trigger or trip mechanism at the end of a carriage assembly run, i.e., when the carriage assembly approaches the end of its travel along the guide bar, may be employed to reposition the shield assembly. That is, the trip mechanism may cause the shield to traverse a spring-biased cam to pivot and maintain its position for the subsequent print head pass. Furthermore, the shield itself may be configured to have a single contact surface disposed laterally of the print head nozzle. As such, the mount may then be configured to reposition the shield from one of two positions. That is, the shield may be pivoted or rotated from one side to the other such that the contact surface engages the print media upstream of the print head nozzle, i.e., the direction/motion of the nozzle.

What is claimed is:

1. A shield assembly for use in combination with a print head of an ink jet printer, the print head supported by a carriage assembly for moving the print head in a direction orthogonal to the feed path of a print media, the shield assembly comprising:

a shield defining a contact surface; and a mount attaching the shield to the carriage assembly such that the contact surface is disposed laterally of the print head nozzle and pivotable about an rotational axis substantially parallel to the feed oath of the print media, the mount, furthermore, operative to reposition the shield such that the contact surface engages the print media upstream of the print head nozzle when depositing ink on the print media.

2. The shield assembly according to claim 1 wherein the shield assembly includes first and second contact surfaces and defines an opening therebetween for permitting the deposition of ink through the opening.

3. The shield assembly according to claim 2 further comprising:

a means for pivoting the shield about a rotational axis in a first and second direction, the pivot means, furthermore, operative to cause one of the first and second contact surfaces to engage the print media upstream of the print head when depositing ink on the print media.

4. The shield assembly according to claim 3 wherein the shield includes a substantially planar portion disposed about the periphery of the opening and wherein the pivot mount is defined by a pair of mounting lugs projecting upwardly from the shield and mounting pins for engaging each of the lugs with a cross member of the carriage assembly.

5. The shield assembly according to claim 2 wherein the print head includes a print head nozzle having a face geometry and the opening of the shield defines a shape substantially complimenting the face geometry of the print head nozzle.

6. The shield assembly according to claim 5 wherein the opening of the shield opening is oversized with respect to the print head nozzle to permit unencumbered motion of the shield relative to the print head.

7. The shield assembly according to claim 1 wherein the contact surfaces produce ramps defining an angle ranging from about ten degrees (10°) to about thirty-five (35°) degrees relative to a horizontal plane.

8. A shield assembly for use in combination with a print head of an ink jet printer, the print head supported by a carriage assembly for moving the print head in a direction orthogonal to the feed path of a print media, the shield assembly comprising:

a shield having first and second contact surfaces and defining an opening therebetween, the opening aligned with the print head to permit the deposition of ink therethrough;

a pivot mount for pivoting the shield about a rotational axis, the rotational axis being substantially parallel to the feed path of the print media and orthogonal to the motion of the print head; and a means for pivoting the shield about the rotational axis in a first and second direction, the pivot means, furthermore, operative to cause one of the contact surfaces to engage the print media upstream of the print head when depositing ink on the print media.

9. The shield assembly according to claim 8 wherein the shield includes a substantially planar portion disposed about the periphery of the opening and wherein the pivot mount is defined by a pair of mounting lugs projecting upwardly from the shield and mounting pins for engaging each of the lugs with a cross member of the carriage assembly.

10. The shield assembly according to claim 8 wherein the print head includes a print head nozzle having a face geometry and the opening of the shield defines a shape substantially complimenting the face geometry of the print head nozzle.

11. The shield assembly according to claim 8 wherein the opening of the shield is oversized with respect to the print head nozzle to permit unencumbered motion of the shield relative to the print head.

12. The shield assembly according to claim 8 wherein the contact surfaces define an angle ranging from about ten degrees (10°) to about thirty-five (35°) degrees relative to a horizontal plane.

13. A method for printing on a print media, the method employing an ink-jet printer having a print carriage for effecting bi-directional motion of the print head, the shuttle print motion orthogonal to the feed path of the print media, the method comprising the steps of:

attaching a shield assembly to a print carriage, the shield assembly including a shield having contact surfaces disposed on each side of the print head, the contact surfaces forming an acute angle relative to a planar surface defined by the print media; the shield, furthermore, adapted to be pivot mounted to the print carriage about a rotational axis, the rotational axis being substantially parallel to the feed path of the print media and orthogonal to the motion of the print head; and displacing at least one of the contact surfaces of the shield assembly to pivot the shield about the rotational axis to engage the print media upstream of the print head when shuttling the print carriage and head in one of two directions;

wherein the contact surfaces engage the print media to provide a planar surface as ink is deposited by the print head.

14. The method according to claim 13 wherein the print head defines a print head nozzle, and wherein the step of providing a shield further includes the step of structurally interconnecting the contact surfaces to define an opening therebetween, the opening having a shape complimenting the shape of the print head nozzle and permitting the deposition of ink therethrough for printing on the print media.

15. A print head assembly for an ink jet printer, comprising:

a print head having a plurality of ink jet nozzles for depositing ink on a print media, a carriage assembly including a print head mounting block and a guide rail disposed orthogonal to a feed path of the print media, the print head mounting block for supporting the print head therein and mounting to the guide rail, a drive motor for positioning the print head mounting block along the guide rail and bi-directionally shuffling the print head parallel to the guide rail and across the print media;

a shield assembly including a shield having first and second contact surfaces disposed at opposite ends thereof and defining an opening disposed between the contact surfaces, the shield assembly furthermore, being pivotally mounted to the carriage assembly about a rotational axis, the rotational axis being substantially parallel to the feed path of the print media and orthogonal to the motion of the print head, the shield furthermore being mounted to the carriage assembly such that the print head is aligned with the opening to permit the deposition of ink through the opening, a means for effecting pivot motion of the shield about the rotational axis in a first and second direction, the pivot means, furthermore, operative to cause one of the contact surfaces to engage the print media upstream of the print head when depositing ink through the opening of the shield.

16. The print head assembly according to claim 15 wherein the shield includes a substantially planar portion disposed about the periphery of the opening and wherein a pivot mount is defined by a pair of mounting lugs projecting upwardly from the shield and mounting pins for engaging each of the lugs with a cross member of the carriage assembly.

17. The print head assembly according to claim 15 wherein the print head includes a print head nozzle having a face geometry and the opening of the shield defines a shape substantially complimenting the face geometry of the print head nozzle.

18. The print head assembly according to claim 15 wherein the opening of the shield is oversized with respect to the print head nozzle to permit unencumbered motion of the shield relative to the print head.

* * * * *